US005378957A

United States Patent [19]

Kelly

[11] Patent Number: 5,378,957

[45] **Date of Patent: * Jan. 3, 1995**

[54] METHODS AND APPARATUS FOR DISPERSING A FLUENT MATERIAL UTILIZING AN ELECTRON BEAM

[75] Inventor: Arnold J. Kelly, Princeton Junction, N.J.

[73] Assignee: Charged Injection Corporation, Princeton Junction, N.J.

[ * ] Notice: The portion of the term of this patent subsequent to Mar. 3, 2009 has been disclaimed.

[21] Appl. No.: 856,901

[22] PCT Filed: Nov. 16, 1990

[86] PCT No.: PCT/US90/06749

§ 371 Date: Jun. 11, 1992

§ 102(e) Date: Jun. 11, 1992

[87] PCT Pub. No.: WO91/07772

PCT Pub. Date: May 30, 1991

Related U.S. Application Data

[63] Continuation-in-part of Ser. No. 438,696, Nov. 17, 1989, Pat. No. 5,093,602.

[51] Int. Cl.[6] ..... H01J 33/04; H01J 17/22; H05F 3/00; B05B 5/025

[52] U.S. Cl. ..... 313/231.01; 313/420; 361/227; 239/3; 239/463

[58] Field of Search ..... 313/231.01, 231.31, 313/231.51, 420; 361/226, 227; 239/463, 3, 704

[56] References Cited

U.S. PATENT DOCUMENTS

| | | | |
|---|---|---|---|
| 4,061,944 | 12/1977 | Gay | 313/420 |
| 4,255,777 | 3/1981 | Kelly | 239/704 |
| 4,439,980 | 4/1984 | Biblarz et al. . | |
| 4,468,282 | 8/1984 | Neukermans | 156/633 |
| 4,494,036 | 1/1985 | Neukermans | 313/420 |
| 4,618,432 | 10/1986 | Mintz | 361/226 |
| 4,991,774 | 2/1991 | Kelly | 239/3 |
| 5,093,602 | 3/1992 | Kelly | 313/231.01 |

FOREIGN PATENT DOCUMENTS

| | | |
|---|---|---|
| 0020049A1 | 5/1980 | European Pat. Off. . |
| WO9115673 | 10/1991 | WIPO . |

OTHER PUBLICATIONS

C. D. Hendricks and J. B. Y. Tsui, "Production of Uniform Droplets by Means of Ion Drag Pump," The Review of Scientific Instruments, vol. 39, No. 8, Aug. 1969, pp. 1088–1089.

Otmar M. Stuetzer, "Ion Drag Pumps," Journal of Applied Physics, vol. 31, No. 1, Jan., 1960, pp. 136–146.

*Primary Examiner*—Donald J. Yuska
*Assistant Examiner*—Brian Zimmerman
*Attorney, Agent, or Firm*—Lerner, David, Littenberg, Krumholz & Mentlik

[57] ABSTRACT

Apparatus for dispersing a fluent material such as a liquid includes a device for discharging a stream of the fluent material and a device for providing energetic electrons such that the electrons impinge on the fluent material to provide a net negative charge on the fluent material in the discharged stream. The fluent material discharged is dispersed at least partially under the influence of the net negative charge so imparted. The electron-supply device includes a chamber separated from the fluid passageway by an electron-permeable membrane, and may also include an electron gun for generating a beam of energetic electrons such that the electron beam passes through the window and impinges on the fluent material. The electrons may impinge on the fluent material as the fluent material is discharged from the device so that the fluid flow carries the charged portions of the fluent material away from the device. The apparatus may be used to atomize liquids even where the liquids are electrically conductive.

41 Claims, 5 Drawing Sheets

METHODS AND APPARATUS FOR DISPERSING A FLUENT MATERIAL UTILIZING AN ELECTRON BEAM

CROSS-REFERENCE TO RELATED APPLICATIONS

The present application is a continuation-in-part of U.S. patent application Ser. No. 07/438,696, filed Nov. 17, 1989, now U.S. Pat. No. 5,093,602.

TECHNICAL FIELD

The present invention relates to methods and apparatus for dispersing a fluent material.

BACKGROUND ART

Numerous technical and industrial processes require dispersion of a fluent material. One such dispersion process is atomization of a liquid into droplets. Atomization is employed in industrial processes such as combustion, chemical treatment of liquids, spray coating and spray painting. It is ordinarily desirable in dispersion processes such as atomization to produce a fine, uniform dispersion of the fluent material. Thus, in .atomization it is desirable to convert the liquid into fine droplets, most desirably droplets of substantially uniform size.

Considerable effort has been devoted heretofore to development of methods and apparatus for dispersing fluent materials. For example, mechanical atomizers which operate by forcing a liquid to be atomized under high pressure through a fine orifice. Such mechanical atomizers are used in oil burners and as fuel injectors in combustion engines. Other mechanical dispersion devices mix the fluent material to be atomized with a gas flowing at high velocity, so that the fluent material is dispersed by the kinetic effect of the high velocity gas.

A technique known as electrostatic atomization has also been employed. In electrostatic atomization, an electrical charge is applied to the fluent material, typically as the fluent material is discharged from an orifice. Because the various portions of the fluent material bear charges of the same polarity, various portions of the fluent material tend to repel one another. This tends to disperse the fluent material. In a rudimentary form of electrostatic atomization, the fluid is discharged from a nozzle towards a counterelectrode. The nozzle is maintained at a substantial electrical potential relative to the counterelectrode. This type of electrostatic atomization is used, for example, in electrostatic spray painting systems. Electrostatic atomization systems of this nature, however, can apply only a small net charge to the fluid to be atomized and hence the electrostatic atomization effect is minimal.

U.S. Pat. No. 4,255,777 discloses a different electrostatic atomization system. As taught in the '777 patent, the fluid may be passed between a pair of opposed electrodes before discharge through the orifice. These opposed electrodes are maintained under differing electrical potentials, so that charges leave one of the electrodes and travel towards the opposite electrode through the fluid. However, the moving fluid tends to carry the charges downstream, towards the discharge orifice. Generally, the velocity of the fluid is great enough that most all of the charges pass downstream through the orifice and do not reach the opposite electrode. Thus, a net charge is injected into the fluid by the action of the opposed electrodes. Systems according to the '777 patent can apply substantial net charge to the fluid and hence can provide superior atomization.

Systems according to the '777 patent, however, can only be applied where the fluid has relatively low electrical conductivity, typically below about 1 microSiemens per meter. Where the electrical conductivity of the fluid is substantially greater than 1 microSiemens per meter, it is difficult to maintain a substantial potential difference between the electrodes. Although numerous organic liquids can be successfully atomized by the methods and apparatus of the '777 patent, many other industrially significant materials are too conductive and hence cannot be atomized or dispersed by the methods and apparatus of the '777 patent. For example, typical aqueous solutions of inorganic materials are highly conductive and hence not readily susceptible to electrostatic atomization according to the method of the '777 patent. These conductive solutions include industrially important material such as water based paints and coatings, comestible materials such as beverage extracts and agricultural materials such as aqueous fertilizer solutions, herbicide solutions and the like.

U.S. Pat. No. 4,618,432 briefly mentions the possibility of using an electron beam to apply a net charge to a liquid (Column 6, line 19), but offers no teaching of how to do so. U.S. Pat. Nos. 4,218,410 and 4,295,808 and Mahoney et al., Fine Powder Production Using Electrohydrodynamic Atomization, conference paper, IEEE-IAS 1984 annual meeting, suggest formation of a metal powder by processes wherein an electron beam impinges on a mass of metal under high vacuum conditions. U.S. Pat. Nos. 2,737,593 and 3,122,633 refer to treatment of liquids by electron beams for purposes other than atomization. U.S. Pat. Nos. 3,636,673; 4,112,307; 4,663,532 and 4,631,444 are directed to various structures employing an electron-permeable membrane, also referred to as an "electron window". A paper by A. Mizuno, Use of an Electron Beam for Particle Charging, IEEE Transactions on Industry Applications, Vol. 26, No. 1 (January/February 1990) discusses the use of electron-beam ionization in a precharger for an electrostatic precipitator and the extraction of negative ions and free electrons from the ionization zone by an applied electric field.

Despite these efforts in the prior art, there has been a substantial, unmet need heretofore for improved methods and apparatus of dispersion. The present invention addresses these needs.

DISCLOSURE OF INVENTION

One aspect of the present invention provides apparatus for dispersing a fluent material. The apparatus according to this aspect of the invention includes an electron-permeable membrane having a first side and a second side, and fluent material discharge means for passing fluent material to be dispersed past the first side of the electron-permeable membrane and discharging the fluent material. The apparatus further includes electron supply means for providing free electrons at the second side of the membrane so that the electrons pass through the membrane and enter the fluent material to provide a net negative charge on the fluent material discharged by the fluent material discharge means. In operation, the discharged fluent material is dispersed at least partially under the influence of the net negative charge imparted by the electrons entering through the membrane. The electron supply means may include a chamber having an interior space on the first side of the membrane, means for maintaining the interior space substantially under a vacuum and means for accelerating electrons to form an electron beam within the interior space and means for directing electrons in the beam through the electron-permeable membrane to impinge upon the fluent material.

The fluent material discharge means may include a body defining a passageway having a downstream end and a discharge orifice at the downstream end of the passageway, and means for advancing the fluent material through the passageway to the discharge orifice so that the fluent material is discharged from the discharge orifice. The electron-permeable membrane preferably is disposed adjacent the discharge orifice so that the electrons passing through the membrane will impinge on the fluent concomitantly with passage of the fluent material through the discharge orifice.

Use of the electron-permeable membrane permits operation of electron supply apparatus such as the electron beam generating apparatus under high vacuum conditions, even though the fluent material is at atmospheric or superatmospheric pressures. This allows use of electron supply apparatus such as electron beam generating equipment and plasma generating equipment which operate most efficiently under low subatmospheric pressures. Moreover, introduction of electrons through the electron-permeable membrane avoids the need to maintain a potential difference across the fluent material and thus facilitates introduction of a net charge into the fluent material even where the fluent material is electrically conductive.

Because the electrons are introduced into the fluent material as the fluent material passes downstream through the discharge orifice, the downstream motion of the material tends to carry the electrically charged portions of the fluent material away from the apparatus before the charge on these portions of the fluent material can dissipate by conduction through the fluent material to the apparatus.

The means for passing the fluent material may include means for projecting the fluent material in a stream surrounding a discharge axis and moving generally parallel to the discharge axis, and the electron supply means may include means for directing electrons into the stream adjacent to the discharge axis. For example, the electron-permeable membrane may be disposed at an injection location upstream of the discharge orifice, and the electron supply means may include electron beam means for directing an electron beam through the membrane substantially in the axial direction from the injection location towards the discharge orifice. The means for passing fluent material may include means for directing fluent material into rotational flow about the discharge axis so as to form a vortex adjacent the discharge axis, and the electron beam means may include means for directing the electron beam into the vortex. Alternatively, the electron-permeable membrane may encircle the discharge axis and may extend downstream of the discharge orifice.

According to a further aspect of the invention, the apparatus may include means for decreasing the static pressure of the fluent material adjacent the electron-permeable membrane. Thus, the passageway may include a venturi section to decrease the pressure of the fluent material. The electron-permeable membrane may be disposed adjacent to this section. Apparatus according to this aspect of the invention is particularly useful where the fluent material includes a gaseous phase. In this case, the density of the gaseous phase decreases with the static pressure. Electrons passing through the membrane encounter less resistance to penetration of, and incorporation into, the fluent material, and dissipation of the electrons through paths of conduction through the fluent material are disrupted. In the case of a liquid, the fluent material may be passed through a mechanical pre-atomizer to obtain a gaseous phase prior to injection of the electrons. The electron-permeable membrane may be disposed either parallel or traverse to the axis of the venturi section.

Since the injection of electrons into the fluent material may produce X-rays or other undesirable electromagnetic radiation, the apparatus may include means for blocking transmission of such radiation from the vicinity of the membrane to the extension of the device. The blocking means may include one or more baffles. The baffles may constitute bounding walls of the passageway for the material and these walls may define a tortuous-path section. This section may be located downstream of the membrane but upstream from the discharge orifice to intercept radiation travelling axially along the passageway prior to its emission from the downstream end of the passageway.

Collisions between free electrons and molecules and/or atoms of the fluent material, and/or atmospheric or other gases, are believed to produce both positive and negative ions. Extraction of the positive ions (cations) from the fluent material enhances the total net negative charge carried by the material. The apparatus, therefore, may include one or more electrodes disposed adjacent the electron-permeable membrane and means for maintaining each such electrode at a relatively negative voltage potential, i.e., at a potential which is negative with respect to the other surfaces in the vicinity of the membrane. The electrodes thus attract cations from the fluent material, and promote application of a net negative change on the fluent material.

The electron-permeable membrane may comprise a film formed from boron nitride ($B_4NH$). The thickness of this film preferably ranges from about two to about three microns. Because of boron nitride's low electron-absorption characteristics, the electron supply means may comprise an electron gun having an electron acceleration potential of about 30 kV or less. The ability to use such a relatively low-energy electron source provides significant advantages in that it minimizes production of unwanted X-ray radiation and requires only simple, low-cost power supplies such as those normally used for cathode-ray tubes.

In another aspect, the present invention provides apparatus for dispersing a fluent material in which the degree of dispersion varies with time. This variation can be in synchronization to the operating cycle of a device receiving the dispersed material. An apparatus according to this aspect of the invention includes means for supplying the material, means for injecting electrons into the material so that the material is dispersed at least partially because of the charge of the electrons, and means for varying in synchronization to the operating cycle of a device receiving the material the quantity of the electrons injected into the material to thereby vary with time the extent of the dispersion in synchronization with this cycle. The means for injecting the electrons may comprise an electron gun, and the means for varying the quantity of electrons injected into the material may comprise means for varying the intensity of an electron beam produced by the gun. The device receiving the dispersed material may be an internal combustion engine, such as a gasoline or diesel engine.

Further aspects of the present invention provide methods of dispersing a fluent material. In such methods, the fluent material to be dispersed may be moved past a first side of an electron-permeable membrane and discharged, whereas electrons may be supplied on the second, opposite side of the membrane so that the electrons pass through the membrane and enter the fluent material so as to provide a net charge on the discharged fluent material. The fluent material may be a liquid and the liquid may be atomized at least partially under the influence of the net negative charge imparted by the electrons. Alternatively, the fluent material may include a gaseous phase and a solid or liquid phase in admixture with the gaseous phase. The fluent material may be either electrically conductive or nonconductive. As discussed above in connection with the apparatus, the electrons may be introduced into the fluent material as the fluent material travels through a passageway and exits from a discharge orifice.

The fluent material may be brought to a reduced static pressure as electrons are injected into the fluent material. Thus, the fluent material may be passed through a venturi, with the electron-permeable membrane disposed adjacent the venturi, and the electrons may be supplied to the second side of the membrane concomitantly with the passage of the material through the venturi. X-rays and other electromagnetic radiation produced upon injection of electrons into the fluent material may be blocked so that such radiation cannot exit from the apparatus. Thus, radiation travelling axially along the passageway may be intercepted prior to exiting the discharge orifice of the downstream end. The fluent material may be directed past one or more electrodes adjacent the first side of the electron-permeable membrane and a relatively negative electrical potential may be applied to such electrodes to attract positively charged particles. The electrons may be supplied by an electron gun which accelerates the electrons through a voltage potential of less than 30 kV and through an electron-permeable membrane consisting essentially of boron nitride.

In accordance with a further method of the present invention, the extent of dispersion of the fluent material is varied with time. This variation may be in synchronization to the operating cycle of a device receiving the dispersed material. In accordance with this aspect of the invention, the fluent material is injected with electrons, and the quantity of electrons is varied in synchronization with the operating cycle of a device receiving the material to thereby vary with time the degree of dispersion in synchronization with this cycle. The injected electrons may be supplied by an electron gun whose beam intensity varies with this cycle.

Other objects, features and advantages of the present invention will be more readily apparent from the detailed description of the preferred embodiments set forth below taken in conjunction with the accompanying drawings.

MODES FOR CARRYING OUT THE INVENTION

Figure 2:
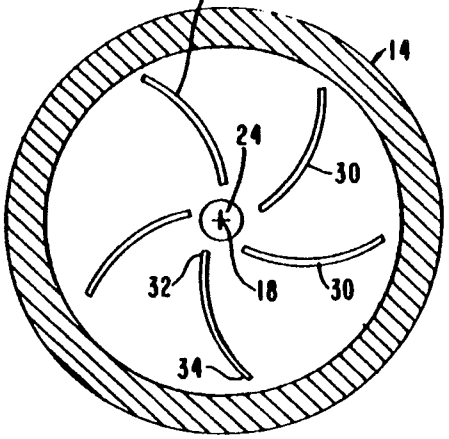
FIG. 2 is a sectional view taken along lines 2—2 in FIG. 1, with portions of the apparatus removed for clarity of illustration.

Apparatus in accordance with one embodiment of the present invention includes a body 10 incorporating a central portion 12 and a cover portion 14 attached to the body portion by threads 16. The body portion and cover portion are substantially symmetrical about an axis 18. The body portion and cover portion cooperatively define a cylindrical space 20 and a general conical space 22 leading to a cylindrical discharge orifice 24. Spaces 20 and 22 and discharge orifice 24 are substantially concentric with one another and are centered on axis 18. Spaces 20 and 22 and discharge orifice 24 cooperatively define a continuous passageway 26, the discharge opening 24 being disposed at a downstream end of the passageway. An inlet opening 28 is provided at the upstream end of the passageway, and communicates with cylindrical space 20. A set of vanes 30 project into the conical space 22 and hence into passageway 26 from cover element 14. As best seen in FIG. 2, vanes 30 are disposed at locations spaced apart circumferentially about axis 18. The vanes 30 extend radially with respect to axis 18 and are also curved in a uniform circumferential direction. Thus, as seen in FIG. 2, the radially inward end 32 of each vane is disposed slightly clockwise of the radially outward end 34 of the same vane, but the vane curves in the anticlockwise circumferential direction with respect to axis 18. A pump 29 is connected to a tank or other source 31 of a liquid to be atomized, and to the inlet opening 28 such that the pump 29 can force a liquid from source 31 into the inlet opening 28.

The central portion 12 of body 10 has a bore 36 coaxial with central axis 18 and extending through the central portion to a circular beam inlet opening 38 on axis 18. Beam inlet opening 38 is covered by an electron-permeable membrane 40, so that the membrane 40 separates the space within bore 36 from passageway 26, and so that the membrane forms a wall of the passageway. Membrane 40 is bonded to the central portion 12 of the body around the entire periphery of beam inlet opening 40, so that the membrane and body cooperatively provide air, gas and liquid impermeable barrier. A first side of membrane 40 faces into the passageway, and a second side of membrane 40 faces away from the passageway, into bore 36. Membrane 40 extends substantially perpendicularly to axis 18 and the first side of membrane 40 faces downstream towards discharge orifice 24. Membrane 40 may be formed from boron nitride, beryllium or other known, electron-permeable materials. Most desirably, the membrane 40 has the minimum thickness required to withstand the pressures encountered in service. To permit use of the thinnest possible membranes, it is desirable to minimize the dimensions of the membrane and hence to minimize the dimensions of opening 38. Where membrane 40 is formed from boron nitride, its thickness may be on the order of about 2 micrometers to about 10 micrometers, and most typically about 3 micrometers. Preferably, the diameter of beam inlet opening 38 is about 2 mm to about 10 mm, and most typically about 3 mm. Where the opening 38 is not circular, the smallest dimension of the beam inlet opening may be about 2 mm to about 10 mm, and desirably about 6 mm. These preferred ranges apply with respect to unreinforced boron nitride membranes. Membrane 40 may be reinforced by a grid or mesh of reinforcing elements (not shown) covering one or both surfaces of the membrane. In this case, the beam inlet opening may have greater dimensions, or the membrane 40 may be thinner than specified above.

Figure 1:
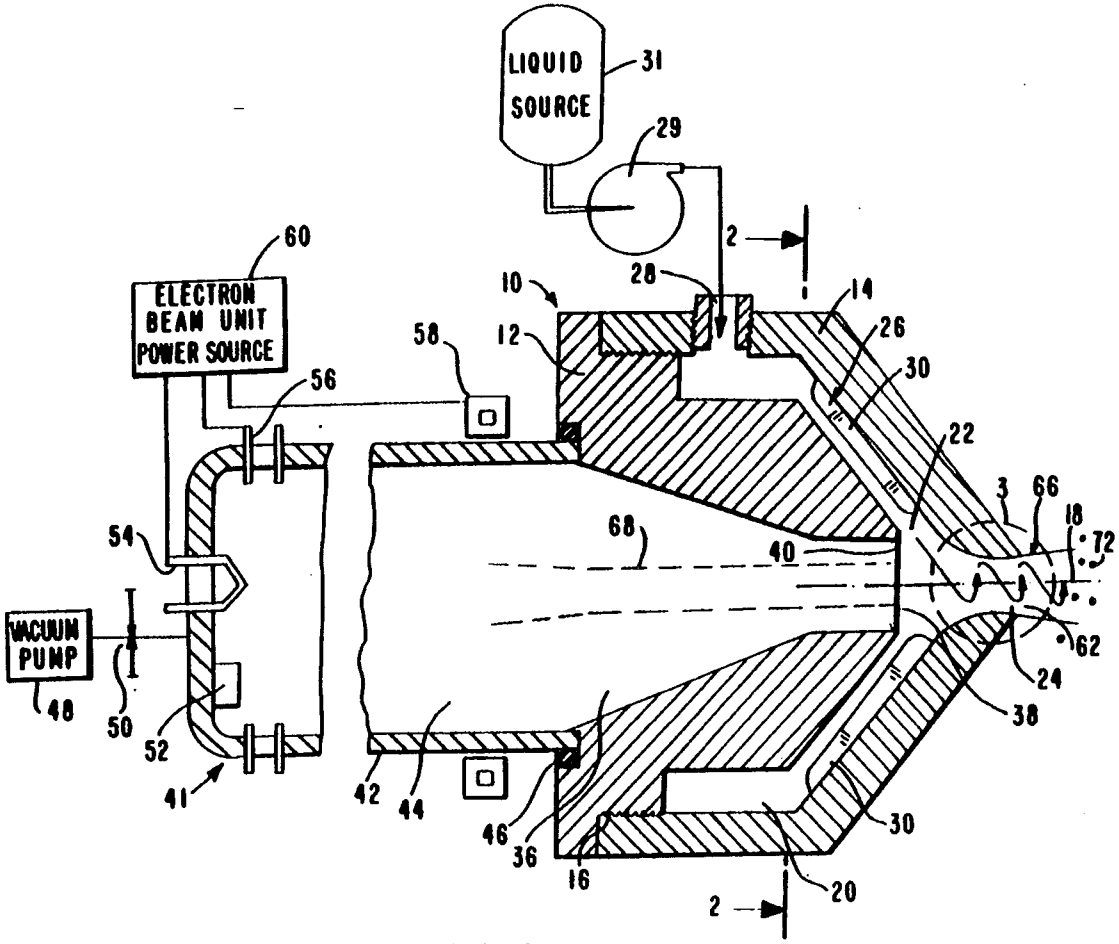
FIG. 1 is a schematic sectional view of apparatus in accordance with one embodiment of the present invention.

The apparatus further includes an electron gun assembly 41 having an enclosed electron accelerating tube 42, of which only a portion is shown in FIG. 1. Accelerating tube 42 is connected to the central portion 12 of body 10 such that the interior space 44 within accelerating tube 42 is in communication with the interior bore 36 of body 12. A high vacuum seal 46 is provided at the juncture of tube 42 and body 12, such that the interior space 44 and bore 36 are effectively isolated from the surrounding atmosphere. When tube 44 is first assembled with body 12, the interior space 44 and bore 36 are evacuated by a conventional vacuum pump 48. After evacuation, the connection between the pump 48 and the interior space may be broken, as by a valve 50 and the pump may be removed. A chemical substance 52 adapted to react with and consume any atmospheric gases present within space 44 is also provided inside of space 44. Such chemical substances are commonly referred to as "getters" and are well known in the electron tube art. Where the seal 46 between the tube and body is particularly effective, the getter may be omitted. Alternatively, where there is appreciable leakage into the interior space 44, the vacuum pump 48 may remain connected to the space.

Desirably, the interior space within the acceleration tube and bore are maintained substantially at a vacuum, i.e., at an internal absolute pressure less than about $10^{-6}$ Torr and desirably less than about $10^{-7}$ Torr. Electron gun assembly 41 is equipped with a conventional cathode 54 and conventional electron accelerating devices such as conductive rings 56 spaced along the length of tube 42. Further, the electron gun assembly includes an electron beam focus device such as the coil 58 schematically depicted in FIG. 1. This device provides a wide focus to the beam such that an even density of electrons appears across the full dimensions of opening 38. The elements of the electron gun assembly are connected to a conventional electrical power source 60 of the type commonly employed for electron beam operations. Power source 60 is arranged to apply a substantial negative electrical potential to cathode 54, and to apply appropriate electrical potentials to rings 56 so that electrons will be discharged from cathode 54 and accelerated away from the cathode by electrostatic potentials applied through rings 56. The power source is arranged to energize coil 58 to provide a focusing magnetic field so as to focus these accelerated electrons into a relatively narrow beam directed substantially along axis 18.

Figure 3:
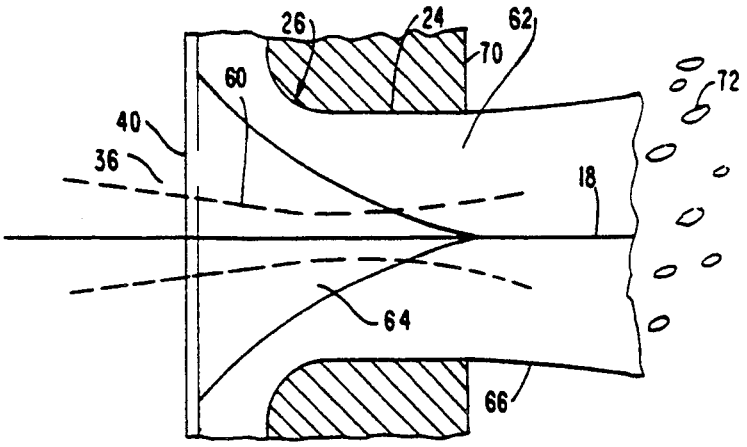
FIG. 3 is a fragmentary, idealized sectional view depicting a portion of the apparatus of FIG. 1 on an enlarged scale.

A method according to one embodiment of the invention utilizes the apparatus discussed above with reference to FIGS. 1–3. Pump 29 is actuated to draw a liquid from liquid source 31 and force the liquid downstream through passageway 26, and hence through discharge orifice 24. The liquid may be an electrically conductive liquid such as an aqueous solution of an inorganic salt, or else may be a substantially nonconductive liquid such as a liquid hydrocarbon. As used in this disclosure with reference to a liquid, the term "conductive" means having an electrical resistivity of less than about $10^6$ ohm-meter. Many conductive liquids have still lower resistivities, typically as low as about 1 ohm-meter or less. The term "non-conductive," as used with reference to a liquid, means having an electrical resistivity greater than about $10^6$ ohm-meter, and typically greater than about $10^8$ ohm-meter.

The liquid passing downstream through passageway 26 encounters vanes 30 as the liquid traverses the conical portion 22 of the passageway and approaches the discharge orifice 24. Vanes 30 impart a swirling, rotational motion about axis 18 to the liquid. As the swirling liquid 62 enters discharge orifice 24, it forms a whirling vortex about axis 18, and hence forms a hollow vortex space or gap 64 (FIG. 3) immediately around the axis 18. The liquid passing through the discharge orifice is projected downstream from the orifice as a whirling stream 66 moving generally parallel to axis 18.

While the pump 29 is in operation, electron gun assembly 41 and power source 60 are actuated to provide a beam 68 of electrons. The beam 68 is directed by focusing coil 58 through electron-permeable membrane 40 and hence into passageway 26. The beam enters the passageway through the membrane 40 at the beam inlet opening 38. The electrons in beam 68 pass downstream from the beam inlet opening generally parallel to axis 18, towards discharge orifice 24. As best appreciated with reference to FIG. 3, the electrons in beam 68 impinge upon the liquid 62 as the liquid passes through orifice 24. The gap or space 64 created by the swirling vortex allows at least a portion of the beam 68 to penetrate downstream into orifice 24 and, depending upon the extent of the vortex, beyond the downstream edge 70 of the orifice. As the space 64 within the vortex is filled with vapors of the liquid and/or atmospheric gases, there may be some interaction between the beam and the gases in the hollow space. However, this interaction is relatively minor, so that the major portion of the electrons in beam 68 impinge upon the liquid 62. As the electron beam 68 passes through membrane 40 and into vortex space 64 and the stream 66, the electron beam encounters gasses within the vortex space and creates negatively charged ions, i.e., gas atoms and/or molecules incorporating one or more additional electrons. The beam spreads away from the axis 18 under the influence of mutual repulsion between the negatively charged electrons and ions. Thus, the beam spreads radially outwardly, away from axis 18 into the body of the stream 66. As the electrons and ions impinge upon the liquid, the liquid assumes a net negative charge. Although the present invention is not limited by any theory of operation, it is believed that some or all of the free electrons in the original beam passing through the membrane may become attached to atoms or molecules and form negative ions before the electron impinges on the fluid stream. However, regardless of whether the electrons are free or attached as ions, the result is the same, in that the electrons pass into the fluid stream. Each negative ion which passes into the fluid stream carries one or more extra electrons into the fluid with it. As the negatively charged portions of the liquid tend to repel one another, the liquid stream 66 fragments into droplets 72, thus atomizing the liquid. The atomization process may be assisted by mechanical action of the liquid passing through the orifice. Thus, the stream 62 will tend to fragment to some extent even in the absence of the electron beam. However, the atomization process is materially enhanced by the negative charges applied by the electron beam.

Where the liquid 62 is conductive, the charge applied to the liquid by the electron beam may be dissipated to some extent by conduction. Thus, the charge applied by the electron beam tends to flow through the liquid to the nearest available ground. Preferably, the nozzle body 10 is formed from an electrically insulating material or else substantially electrically isolated from ground. Liquid source 31 and pump 29 may themselves be isolated from an electrical ground, so that as the system operates, the liquid source, the pump, the conduits connecting them to the inlet opening 28 and the liquid within them assume a net negative charge. Alternatively, the conduits connecting the pump 29 to the inlet opening may be formed from an insulating material, and may be relatively small across section and relatively substantial in length, so that the only electrical pathway from the nozzle to the pump is a high impedance pathway through the liquid column in the conduits. This arrangement minimizes current flow and hence charge dissipation, even where the pump 29 is grounded.

Even where there is an available electrical path from the liquid to ground, as where the nozzle body itself is conductive and grounded, or where there is a high conductivity pathway through the liquid conduits, not all of the charge applied by the electron beam will be dissipated. The velocity of charges in a typical conductive liquid is finite, and is considerably less than a velocity of light. In a typical conductive liquid, charges are transferred by diffusion of ions through the liquid under the influence of the voltage gradient or prevailing electric field. Such diffusion proceeds at a rapid but finite speed. In the preferred embodiments of the present invention, the charges are injected into the liquid just as the liquid passes through the discharge orifice. At this point, the liquid is passing downstream, away from body 10 at a substantial velocity. If the downstream velocity of the liquid exceeds the charge velocity in the liquid, the charges will move downstream with the exiting liquid stream, away from the body and away from the discharge orifice 24. Even where body 10 is grounded and electrically conductive, some or all of the charge applied by the electron beam will remain in the exiting liquid.

The charge remaining in the exiting liquid desirably amounts to at least about $3\times10^{-3}$ coulombs per liter of fluid discharged and higher levels of charge, on the order of at least about $4\times10^{-3}$ coulombs per liter or at least about $5\times10^{-3}$ coulombs per liter are more preferred. Thus, for each ml/sec liquid flow through the system, the current of electrons in electron beam 68 amounts to about $3\times10^{-6}$ amperes or more, and preferably about $4\times10^{-6}$ and most desirably at least about $5\times10^{-6}$ amperes. Still higher levels of beam current are even more desirable. Desirably, the beam voltage (the kinetic energy of the electrons in beam 68) amounts to about 15 kV. Higher energy levels are useful and preferred. However, generation of electron beams at energy levels above about 30 kV generally requires more complex equipment incorporating special, expensive high voltage insulation in the power supply. Accordingly. electron beam of voltages within a range of about 15 kV to about 30 kV are most preferred.

The apparatus and methods discussed above may be employed using a wide variety of fluid materials. In particular, both conductive and non-conductive liquids may be atomized. Substantially the same apparatus and methods can be used to treat fluent materials incorporating a solid phase, such as a fluent powder or a suspension of a solid in a liquid or gas. In this case, the individual particles of the solid may be charged by exposure to the electron beam, and hence may be dispersed by processes including a mutual repulsion of the charged particles. Typically, the shape and size of the passageway 26 in body 10 would be selected to accommodate a flow of the solid particles of material without binding or jamming, and the solid particles of material would be fed by an appropriate feeding device such as a vibratory feeder, ram or the like. Processes according to this aspect of the invention provide a dispersion of the solid particle material in the surrounding atmosphere, rather than atomization of a liquid. As used herein, the term "a dispersion" and the "dispersing" should be understood broadly, as encompassing both dispersion of a solid particle material and atomization of a liquid material.

The liquid droplets or dispersed solids provided at the downstream portion of the fluent material stream may be employed in substantially the same way as liquid droplets created by conventional nozzles. Thus, liquid droplets resulting from the process may be blended with a gas, as in a combustion process or in creation of a fog, mist or vapor. The droplets may also impinge on a solid substrate, such as a workpiece to be coated with the liquid. The substrate (not shown) may be grounded or may be maintained at a positive potential relative to ground so as to attract the negatively charged droplets. Likewise, where fluent solid material is dispersed, the same may be applied to a solid substrate, and the solid substrate may be positively charged to attract the solid particles.

In the apparatus and methods discussed above, the stream of electrically charged fluent material passes downstream from the discharge orifice into the atmosphere. Corona discharge or electrical breakdown of the atmosphere surrounding the stream may cause some dissipation of the electrical charge on the fluent material hence may limit the charge which can be maintained in the stream to produce a dispersion. To suppress such a corona discharge, the stream may be surrounded with a blanket of a dielectric gas. Such blanket need only extend downstream to about the point where the stream becomes substantially dispersed. As disclosed in U.S. Pat. No. 4,605,485, the dielectric gaseous stream may be provided by a separate, annular orifice surrounding the discharge orifice of an electrostatic atomization device. Conversely, as disclosed in a U.S. Pat. No. 4,630,169, the inert gas blanket may be provided by adding a volatile dielectric liquid to the fluent material to be atomized prior to discharge of the fluent material through the discharge orifice, so that the dielectric gas blanket is formed by vapors of the volatile liquid. Either of these approaches may be employed with atomization methods and apparatus according to the present invention.

The measures disclosed in copending, commonly assigned U.S. patent application Ser. No. 07/398,151, filed Aug. 24, 1989 may also be employed. The disclosure of said U.S. patent application Ser. No. 07/398,151 is hereby incorporated by reference herein. As disclosed in greater detail in said '151 application, the charged fluid stream may be protected from the surrounding atmosphere by a mist, which may be formed from the same or a different liquid as incorporated in the principal stream to be atomized. Even a conductive liquid may form a useful mist for this purpose. Alternatively or additionally, the stream may be surrounded by a vapor formed by heating a portion of the principal liquid to be atomized.

The apparatus according to the present invention typically is operated to discharge the stream of fluent material to be dispersed into a surrounding atmosphere which is at a moderate subatmospheric pressure of about 1 kPa absolute or above, or at about normal atmospheric pressure or above (about 100 kPa absolute). The pressure of the fluent material within passageway 26 will depend upon the factors such as the flow rate of the fluent material, its viscosity or resistance to flow and the dimensions of the passageway and discharge orifice 24. Typically, however, the fluent material is under atmospheric or superatmospheric pressures. As discussed above, the electron-permeable membrane 40 effectively isolates the interior space 44 within the electron gun chamber from these high fluid pressures and hence permits acceleration and focusing of the electron beam substantially in a vacuum.

Figure 4:
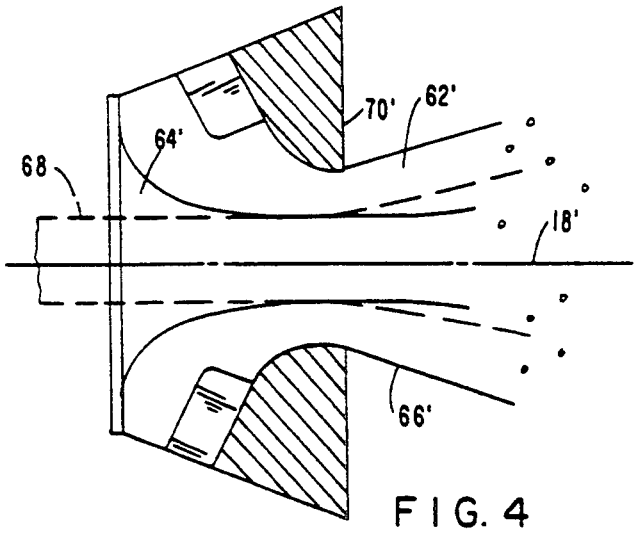
FIGS. 4, 5 and 6 are views similar to FIG. 3 but depicting apparatus according to additional embodiments of apparatus according to the invention.

As illustrated diagrammatically in FIG. 4, the vortex opening 64' within the swirling mass of fluid 62' may extend downstream to the point where the fluid stream 66' breaks into droplets. In this case, the electron beam 68' may pass downstream within vortex opening 64'. Nonetheless, the electron beam will impinge upon the fluid in the stream. As the electrons in the beam and ions incorporating such electrons tend to repel one another, the beam spreads radially outwardly, away from axis 18' as it passes downstream, so that the electrons (whether free or ion-attached) in the beam will pass radially outwardly, away from axis 18' and enters the stream of fluent material. The electrons may enter the fluent material over a region of the stream extending from upstream of the downstream edge 70' of the discharge orifice to downstream of such edge. Depending upon the configuration of the stream and of the beam, the electrons may enter the fluent material entirely downstream of the discharge orifice.

Figure 5:
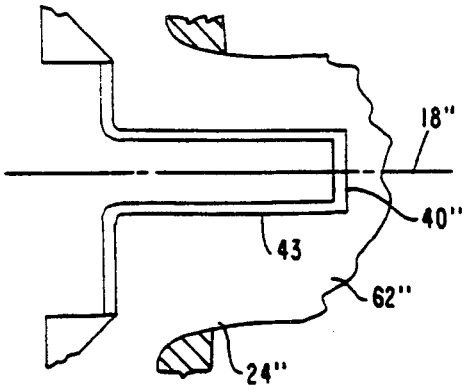

As seen in FIG. 5, the electron-permeable membrane 40'' need not be planar as in the embodiments discussed above but may instead incorporate a cylindrical portion 43 protruding downstream through the discharge orifice 24''. Here again, as the electron beam passes downstream within the protruding cylindrical portion 43, it will spread radially outwardly, away from the central axis 18''. Accordingly, electrons will pass outwardly through this region of the electron-permeable membrane into the fluid 62''.

Figure 6:
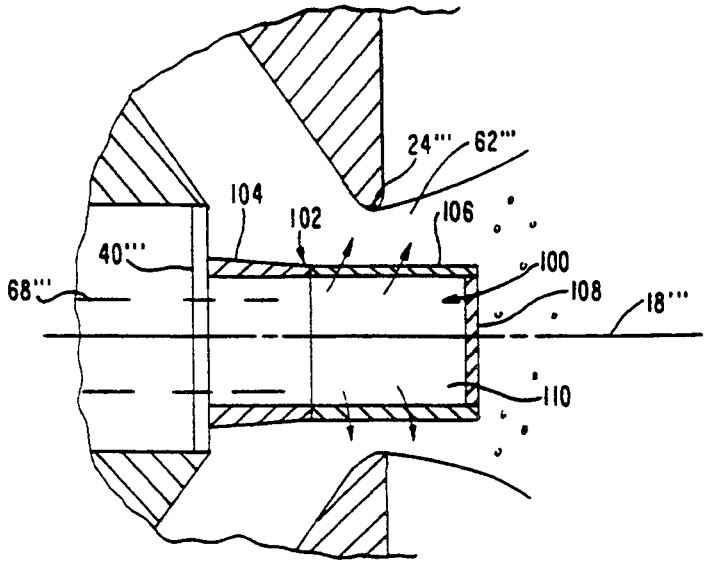

The apparatus illustrated in FIG. 6 has a generally planar electron-permeable membrane 40''' similar to the membrane 40 of the apparatus discussed above with reference to FIGS. 1–3. Membrane 40''' is mounted upstream of the discharge orifice 24'''. A secondary ionization chamber 100 overlies the portion of membrane 40''' on the axis 18''' and protrudes axially downstream through the discharge orifice 24'''. Chamber 100 has a cylindrical wall 102 incorporating a nonporous cylindrical section 104 adjacent membrane 40''' and a porous, electron-permeable membrane section 106 remote from membrane 40''' and lying adjacent the downstream end of chamber 100. The downstream end of chamber 100 is closed by an impermeable plug 108, whereas the upstream end of the chamber is closed by membrane 40'''. The interior space 110 within chamber 100 is filled with a readily ionizable gas such as neon, argon, helium, krypton or xenon, or combinations thereof, under subatmospheric pressure. The porosity of the wall or membrane section 106 is selected such that the membrane is substantially impermeable to liquids and to the gas within the interior space 110, but substantially permeable to free electrons having moderate energy levels. Among the materials having this property are sintered glasses having a nominal pore size on the order of about 20 to about 40 Angstroms. Suitable sintered glasses are available from Corning Glass Works of Corning, New York under the designation Expanded Vycor, Code 7930. In other respects, the embodiment illustrated in FIG. 6 is similar to the apparatus discussed above with reference to FIGS. 1–3. In operation, the electron beam 68''' generated by the electron gun assembly (not shown) passes through the electron-permeable membrane 40''' and into the space 110 within secondary ionization chamber 100. As electrons enter the chamber, they ionize the gas within chamber 110, thus converting the gas to a plasma or mixture of gas ions and free electrons. Also, as free electrons in the electron beam enter chamber 110, the plasma acquires a net negative charge. Mutual repulsion of the electrons in the plasma forces free electrons out through the membrane or wall 106. As the fluid 62''' passing out through discharge orifice 24''' surrounds membrane or wall 106, electrons passing through the membrane enter the fluid as the fluid passes through the discharge orifice. Because the membrane 106 is located adjacent the downstream edge of the discharge orifice, and because the membrane or wall 106 protrudes beyond the downstream edge of the discharge orifice, electrons are introduced into the fluid in the region of the stream at and downstream of the discharge orifice. As in operation of the embodiments discussed above, the electrons introduced into the fluid impart a net negative charge to the fluid and cause it to disperse into droplets. The upstream, impermeable wall 104 of the secondary chamber prevents escape of free electrons from the space 110 within the secondary chamber to the fluid at substantial distances upstream from the discharge orifice. As discussed above, introduction of the charge into the fluid at the downstream location tends to assure that the charges will be swept downstream with the moving fluid, and hence will remain in the fluid even when the fluid has substantial conductivity.

Figure 7:
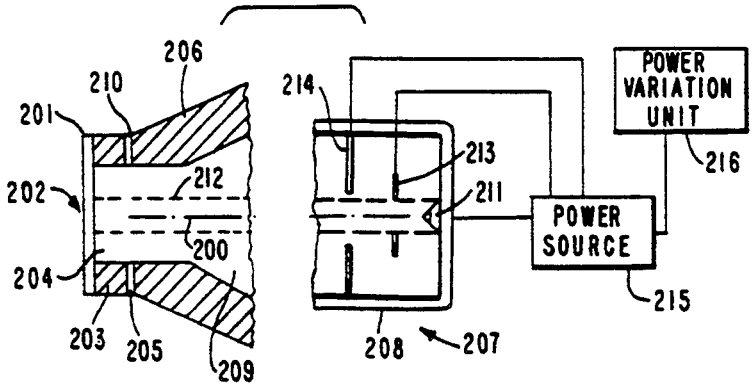
FIG. 7 is a schematic sectional view of apparatus in accordance with another embodiment of the present invention.

FIG. 7 illustrates additional features of the present invention. Electron window 202 comprises a thin film of boron nitride ($B_4NH$) which is disposed on a silicon substrate 203. This film may be deposited on the substrate through vacuum evaporation, cathode sputtering or similar techniques. A thin film of aluminum 205, which may be deposited on the substrate using similar techniques, is disposed on the opposite side of the substrate. A hole 204, etched through the aluminum and substrate layers, is disposed in the center of these layers. The outer annular aluminum layer is bond to body 206 through an ionic bond 210 between this body and layer 205.

Body 206 has a bore 209 coaxial with the central axis 200 of the body and electron gun 207. A high vacuum seal (not shown) is provided at the juncture of gun 207 and body 206. The electron gun includes cathode 211, grid 213 and anodes 214. Various voltages are applied to these elements by power source 215 to cause the emission of an electron beam 212 to pass from the cathode, through the partial vacuum within tube 208 and bore 209, and through boron nitride layer 201 of electron window 202 to impinge upon fluent material (not shown) flowing past and adjacent this layer. The voltages applied by power source 215 to cathode 211, grid 213 and/or anodes 213 are selectively varied with time by power variation unit 216.

A method according to an embodiment of the invention utilizes the apparatus of FIG. 7 to vary with time the quantity of electrons injected into the fluent material to thereby vary with time the extent of dispersion of this material caused by the injected charge. This feature of the invention is particularly useful when the fluent material is a liquid and is discharged into a device having an operating cycle whose optimum atomization requirements vary in synchronization with the cycle, e.g., a fuel injector for an internal combustion engine. Power variation unit 216 causes power source 215 to selectively vary the voltage between cathode 211 and grid 213, in accordance with the dispersion requirements for the fluent material, to cause a corresponding variance in the intensity of electron beam 212. The quantity of electrons passing through electron window 202 and, therefore, into the fluent material, similarly varies with the variation of voltage between the cathode and grid of electron gun 207.

Boron nitride layer 201 offers minimal resistance to passage of electron beam 212 through window 202. As a result, the degree of acceleration imparted to the electrons by gun 207 need not exceed 30 kV in order that a sufficient charge is applied to the fluent material for most applications. Power source 215 applies a voltage of 15 to 30 kV between cathode 211 and anodes 214. Small electron guns applicable to portable televisions can function for this purpose.

Figure 11:
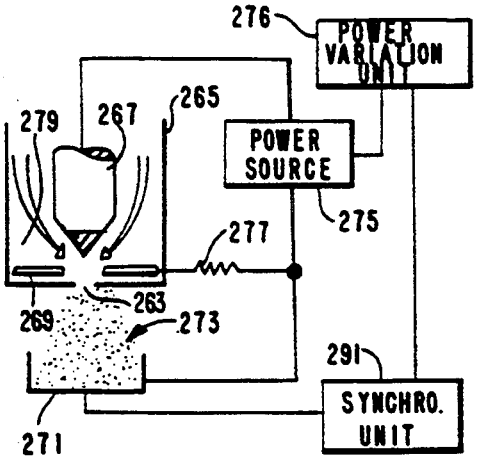
FIG. 11 is a schematic representation of apparatus in accordance with another embodiment of the invention.

FIG. 11 illustrates a different electrostatic atomization system, similar to that disclosed in U.S. Pat. No. 4,255,777, the disclosure of which is hereby incorporated by reference herein. Power source 275 impresses a voltage differential between central electrode 267 and an opposed electrode 269 within housing 265. Opposed electrode 269 can be affixed to, or be part of, the forward wall of this housing. This voltage differential causes electrons to leave central electrode 267 and travel toward opposed electrode 269 through fluid 279. This fluid flows within the housing, around central electrode 267 and through discharge orifice 263. A pump (not shown) advances the fluid from a reservoir (also not shown) through the housing and discharge orifice. Since the moving fluid carries the electrons downstream, toward the discharge orifice, most of the electrons pass through the orifice and do not reach opposed electrode 269. After exiting through the orifice, the charged fluid 273 undergoes disruption and atomization. Current returns to the circuit by collector electrode 271 which, in this case, is the wall of a cylinder of an internal combustion engine. Resistor 277 limits the electrode current in the event of an internal breakdown in the fluid.

Power variation unit 276 controls power source 275 to impart a selected, time-varying voltage between the central and opposed electrodes. In this case, this voltage is determined by synchronization unit 291 which monitors the operating cycle of the engine and provides a synchronization signal to power variation unit 276 synchronized to this cycle. Power variation unit 276 causes the amount of charge injected into fluid 279 to vary in response to this signal and, therefore, in synchronization to the combustion cycle of the engine. The degree to which the fluid is atomized after exiting orifice 263, therefore, also follows this same synchronized cycle. Since the degree of atomization of the fluid is timed to the engine's combustion cycle, an optimum degree of atomization can be provided to the fluid throughout the cycle. As used herein, the phrases "degree or extent of atomization" and "degree or extent of dispersion" refer to the number and average size of droplets or particles per unit volume of fluent material. A higher degree of atomization or dispersal results in more droplets or particles per unit volume of the material.

Figure 8:
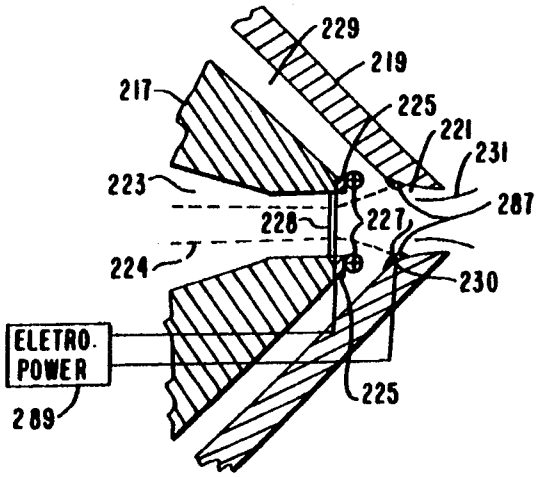
FIG. 8 is a fragmentary, sectional view depicting additional apparatus according to the invention.

FIG. 8 illustrates an embodiment of the invention in which electrodes 225 are disposed on central body 217, adjacent electron-permeable membrane 228, and opposed electrodes 287 are disposed across from these electrodes on cover element 219. The other components of the apparatus illustrated in FIG. 8 are the same as that of FIG. 1. Thus, fluent material 231 travels through passageway 229, formed by central body 217 and cover element 219, and is discharged through orifice 221. Electron beam 224 travels through bore 223 and electron-permeable membrane 228 into fluent material 231 as the material travels past the outer surface of the membrane and through Orifice 221. As discussed above, it is believed that when electron beam 224 passes through membrane 228 and into the vortex space 230, negatively charged ions (anions), i.e., gas atoms and/or molecules incorporating one or more electrons in addition to their normal complement of electrons, are produced. Some of these ions, along with free electrons, impinge upon fluent material 231 to impart a net negative charge to this material.

Although the present invention is not limited to any theory of operation, it is believed that the introduction of free electrons into vortex space 230 also produces positively charged ions (cations), i.e., gas atoms and/or molecules missing one or more of their normal complement of electrons. It is believed that collisions between free electrons and neutrally charged atoms and/or molecules result in the capture of one or more free electrons by these atoms or molecules, in some cases, and in the dislodging of one or more electrons from these atoms or molecules in other cases. The introduction of atoms or molecules missing one or more of their electrons (cations) into the fluent material decreases the net negative charge of the material as it exits orifice 221. Electrodes 225 are positioned adjacent the vortex area to extract cations 227 from the fluent material. Electrode power unit 289 applies a negative voltage, e.g., approximately −1.5 kV, to these electrodes with respect to the surrounding elements of the apparatus to attract the positive ions and withdraw them from the vortex region. Unit 289 holds opposed electrodes 287 at ground potential, or at a slightly positive potential, such that a voltage gradient is maintained between central body 217 and cover element 219 which pulls positively charged particles toward the central body, away from the vortex, and negatively charged particles in the opposite direction, toward the vortex. This arrangement minimizes the relative effect of these cations and increases the overall negative charge applied to the fluent material.

Figure 9:
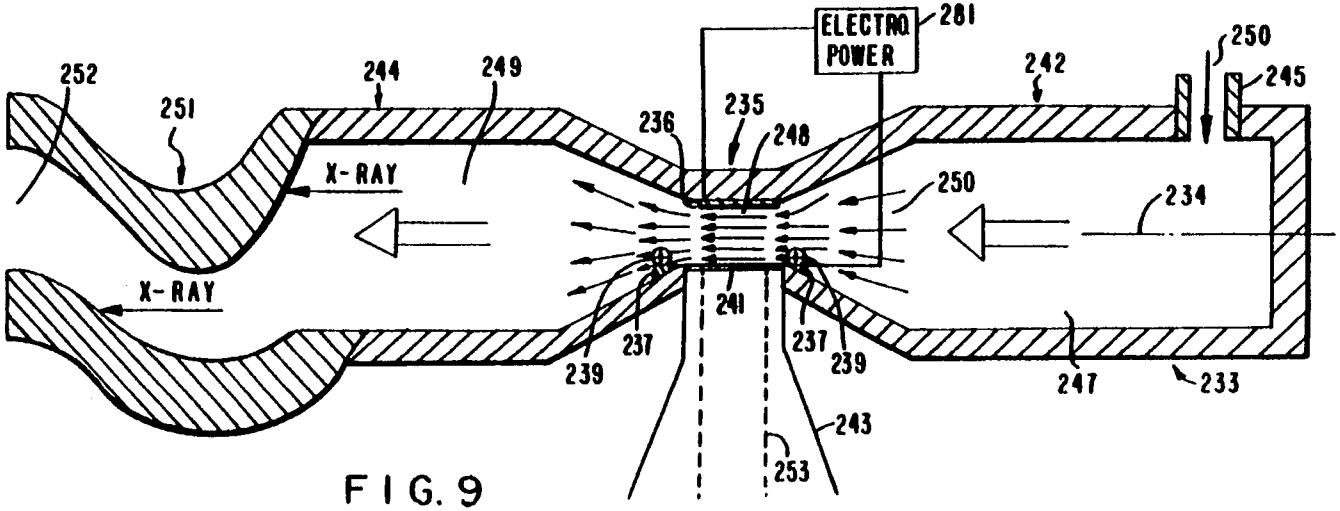
FIG. 9 is a schematic sectional view of apparatus in accordance with another embodiment of the present invention.

FIG. 9 illustrates yet another embodiment of the present invention. Cylindrical body 233 comprises inlet section 242, venturi section 235 and outlet section 244. These sections enclose concentric cylindrical spaces 247, 248 and 249, respectively, about axis 234. The cross sectional area of cylindrical space 247 progressively narrows in the direction of venturi section 235. The cross sectional area of cylindrical space 249 also progressively narrows in the direction of venturi section 235. The cross sectional area of cylindrical space 248 is substantially less than that of both cylindrical spaces 247 and 249.

The apparatus illustrated in FIG. 9 further includes an electron gun assembly 243 which provides a beam of electrons through electron-permeable membrane 241. This beam penetrates into body 233 at venturi section 235. A pump (not shown) forces fluent material 250 through inlet opening 245 and advances this material through cylindrical space 247 and in the direction of the venturi section. As this material is forced through the progressively narrowing cylindrical space formed by inlet section 242 and the venturi section, the pressure exerted by the material substantially decreases in accordance with well known principles. Although the fluent material may be under atmospheric or superatmospheric pressures before reaching these sections, subatmospheric pressures can be obtained within these sections. This embodiment of the invention takes advantage of these subatmospheric pressures for insertion of electron beam 253 at this point into the fluent material. It is believed that the decreased pressure within the venturi section enhances the degree to which electron beam 253 penetrates the fluent material prior to disruption of the beam.

Figure 12:
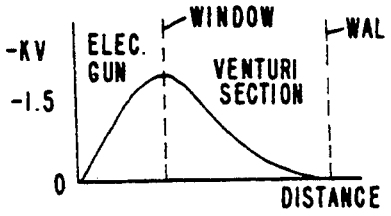
FIG. 12 is a diagram illustrating the potential gradient extending through the electron window of the embodiment of FIG. 9.

This embodiment is particularly useful for treating fluent materials incorporating gaseous and solid materials, such as a powder and gas suspension. Although the present invention is not limited to any theory of operation, it is believed that the use of a venturi at the point of injection of free electrons into such fluent material also promotes the production of anions and the incorporation of their negative charge into the material. Positively charged cations 239, which, as explained above, also may be generated from collisions between the fluent material and electron beam 253, are pulled away from the material by electrodes 237. These electrodes are disposed within venturi section 235 and adjacent to, and on each side of, electron-permeable membrane 241. Electrode power unit 281 applies a substantially negative voltage to electrodes 237 with respect to the surrounding walls of venturi section 235, e.g., approximately −1.5 kV, to attract positively charged particles and withdraw them from this region and the fluent material. Electrode power unit 281 holds opposed electrode 236, disposed on the opposite wall of the venturi section, at ground, or at a slightly positive voltage, in order that a voltage gradient is maintained across the venturi section as illustrated in FIG. 12.

This figure shows that the voltage gradient peaks at approximately −1.5 kV at or near electron-permeable membrane 241 and then progressively drops off, i.e., becomes more positive, extending away from the membrane in the direction of the opposite wall of the venturi section and also in the direction of the internal chamber of the electron gun. The kinetic energy of the electrons is sufficient to overcome this peak negative voltage and propel them into the venturi section. The electrons then are pulled by the voltage gradient further into this section while positively charged cations are pulled back toward electrodes 237 and away from this section.

The charged fluent material travels from venturi section 235 through outlet section 244, tortuous-path section 251 and discharge orifice 252. X-rays, and other electromagnetic radiation caused by collisions between electron beam 253 and the molecules or atoms comprising fluent material 250, are intercepted by tortuous-path section 251. This section prevents the exiting of this radiation through discharge orifice 252 and possibly causing harm to an operator of the apparatus. Tortuous-path section 251 intercepts all optical paths between cylindrical space 249 and orifice 252.

Figure 10:
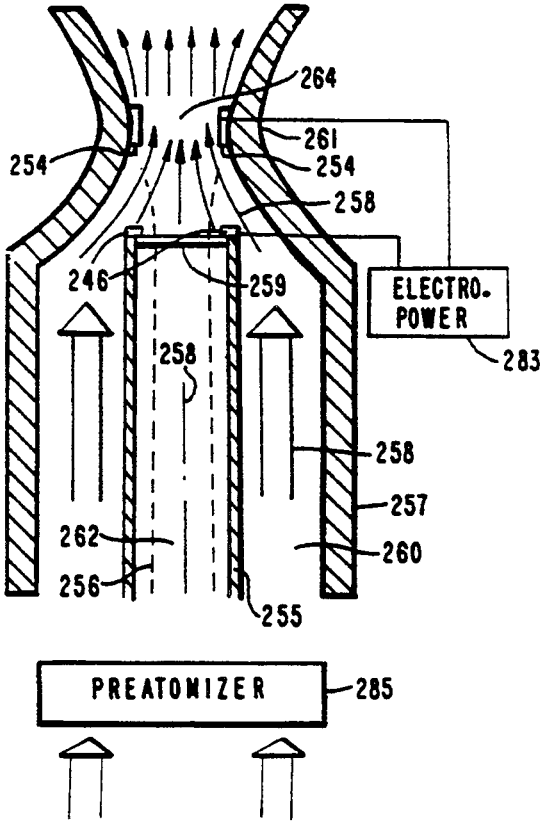
FIG. 10 is a schematic sectional view depicting a variation of the apparatus illustrated in FIG. 9.

A variation of the apparatus of FIG. 9 is shown in FIG. 10. Inlet section 257 encloses cylindrical space 260 within which is disposed central body 255. This body encloses cylindrical space 262 which is concentric, about axis 258, with cylindrical space 260. The cross sectional area of cylindrical space 260 progressively decreases in the direction of venturi section 261 in a manner similar to that of cylindrical space 247 of the embodiment illustrated in FIG. 9. The cross sectional area of cylindrical space 264 enclosed by venturi section 261 is substantially less than that of cylindrical space 260 and also is substantially less than that of the cylindrical space of the outlet section (not shown) connected to the opposite side of the venturi section. An electron gun assembly (not shown) provides a beam of electrons 256 traveling axially within central body 255. This beam exits electron-permeable membrane 259 traveling generally in the same direction as fluent material 258 as this material travels through venturi section 261. It is believed that injection of the electron beam into the fluent material in this direction may enhance the degree of penetration of the beam into the material at the venturi section and, therefore, the amount of charge carried by the material as it travels through the outlet section and discharge orifice.

Electrodes 246 are disposed within venturi section 261 and on each side of electron-permeable membrane 259, and opposed electrodes 254 are disposed on opposite, internal walls of the venturi section downstream from electrodes 246. Electrode power unit 283 applies voltages to electrodes 246 and 254 of approximately −1.5 kV and ground (or slightly positive), respectively, such that a voltage gradient similar to that illustrated in FIG. 12 is maintained within the venturi section. In the same manner as explained above in connection with FIG. 9, after overcoming the peak negative voltage in the vicinity of electron-permeable membrane 259, electrons are pulled by this gradient into the venturi section, and positively charged particles are pulled in the opposite direction out of this section and toward electrodes 246.

The use of a venturi at the point of injection of free electrons into the fluent material is particularly useful in treating fluent materials having a gaseous phase because the density of such materials significantly decreases in response to the decreased pressure within the venturi section. This decrease in density enables enhanced penetration of the electron beam while inhibiting paths of conduction through the fluent material to ground. In order to take advantage of these beneficial effects when the fluent material is a fluid, pre-atomizer 285 is disposed within inlet section 257, upstream from the venturi section, to impart a gaseous phase to the fluid. The pre-atomizer forces the liquid under pressure through small orifices to provide a coarse atomization to the fluid and a concomitant production of a gaseous phase. The coarsely atomized fluid then is passed through the venturi section where the gaseous phase is enhanced and electrons are injected.

Numerous variations and combinations of the features discussed above can be utilized without departing from the present invention as defined by the claims. For example, sources of electrons other than an electrostatic accelerating gun can be employed. Also, in embodiments employing a secondary chamber as discussed above with reference to FIG. 6, the porous wall may be so porous that some of the gas within the chamber escapes. In that case, the secondary chamber can be continually refilled with gas. In a variant of this approach, the secondary chamber can be continually refilled with a plasma bearing a net negative potential supplied by an external plasma generator such as a radio frequency plasma generator and charged by contact with electrodes maintained at a high negative potential. In this case, the electron beam and associated beam-generating apparatus may be omitted. Also, in apparatus such as that discussed with reference to FIGS. 5 and 6, where the apparatus itself incorporates a solid body defining an internal passageway within the stream, there is no need to provide the vortex discussed above with reference to FIGS. 1–4. Therefore, the fluid pathway need not be equipped with vanes 30 (FIG. 2) or other elements for providing rotational movement of the flowing fluid. As these and other variations and combinations of the features discussed above can be utilized, the foregoing description of the preferred embodiment should be taken by way of illustration rather than by way of limitation of the invention as defined by the claims.

What is claimed is:

1. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, the method further comprising the step of removing positively charged particles from said fluent material in the vicinity of the first side of said membrane prior to dispersion of said fluent material.

2. A method as claimed in claim 1, wherein said step of removing positively charged particles includes the step of maintaining an electrode at a relatively negative electrical potential in the vicinity of said membrane in contact with the fluent material.

3. A method as claimed in claim 2, wherein said fluent material includes a gaseous phase, the method further comprising the step of maintaining the static pressure of said fluent material at a subatmospheric pressure as the fluent material passes said membrane.

4. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, the method further comprising the step of varying the quantity of said electrons at said second side with time.

5. A method as claimed in claim 4, wherein said step of supplying electrons comprises forming an electron beam with an electron gun, and wherein said step of varying the quantity of said electrons comprises varying with time the quantity of electrons emitted by said gun.

6. A method as claimed in claim 4, wherein said step of varying the quantity of said electrons comprises varying said quantity in synchronization to the operating cycle of a device receiving said discharged fluent material.

7. A method as claimed in claim 6, wherein said device is an internal combustion engine.

8. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, wherein said electron-permeable membrane comprises a film formed from boron nitride, and said step of supplying electrons comprises the step of accelerating said electrons with an electron gun through a voltage potential of less than 30 kV.

9. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrodes pass through the membrane and enter the fluent material so as to provide a net charge on the discharged fluent material, whereby the discharged fluent material is dispersed at least partially under the influence of said net charge, wherein said fluent material is a liquid, and wherein said step of passing comprises imparting a gaseous phase to said liquid before passing said liquid past said electron-permeable membrane.

10. A method as claimed in claim 9, wherein said step of imparting comprises mechanically atomizing said liquid.

11. A method for dispersing a fluent material, comprising:

(a) supplying said material;

(b) injecting electrons into said material so that said material is dispersed at least partially because of the charge of said electrons;

(c) discharging said fluent material into a device having an operating cycle; and (d) varying the quantity of said electrons injected into said material in synchronization with said operating cycle of said device to thereby vary the extent of said dispersion in synchronization with said operating cycle of said device.

12. A method as claimed in claim 11, wherein said device is an internal combustion engine.

13. A method as claimed in claim 11, wherein said step of injecting electrons comprises applying an electrical potential between a pair of opposed electrodes to cause one of said electrodes to inject electrons into said material under the influence of said potential, said step of supplying said fluent material comprises passing said material between said electrodes concomitantly with the injection of said electrons into said material, and said step of varying the quantity of said electrons comprises varying the electrical potential between said electrodes.

14. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, the method further comprising the step of blocking the transmission of x-ray radiation from the vicinity of said electron-permeable membrane.

15. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and so that the discharged fluent material is dispersed at least partially under the influence of said net charge, said fluent material discharge means including a body defining a passageway having a narrow section forming a venturi, and means for forcing the fluent material to flow through said passageway so that the pressure of the fluent material is reduced below the pressure of the fluid in other regions of said passageway as the fluent material passes through said section and wherein said electron-permeable membrane is disposed adjacent said section so that electrons provided by said electron supply means enter the fluent material in said section while said fluent material is under reduced pressure.

16. Apparatus as claimed in claim 15, wherein said electron-permeable membrane is disposed generally parallel to the axis of said section.

17. Apparatus as claimed in claim 15, wherein said electron-permeable membrane is disposed generally transverse to the axis of said section.

18. Apparatus as claimed in claim 15, wherein said electron supply means includes an electron gun for directing an electron beam through said membrane into said venturi section.

19. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and so that the discharged fluent material is dispersed at least partially under the influence of said net charge, the apparatus further comprising shielding means for blocking transmission of radiation from the vicinity of said electron-permeable membrane.

20. Apparatus as claimed in claim 19, wherein said fluent material discharge means includes a body defining a passageway having a downstream end and means for advancing the fluent material within said passageway to said downstream end, said electron-permeable membrane confronting said passageway upstream of said downstream end, said shielding means including at least one baffle disposed in said passageway between said electron-permeable membrane and said downstream end of said passageway.

21. Apparatus as claimed in claim 20, wherein said at least one baffle includes at least one wall section of said body bounding said passageway and defining a tortuous-path section in said passageway between said electron-permeable membrane and said downstream end.

22. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and so that the discharged fluent material is dispersed at least partially under the influence of said net charge, the apparatus further comprising an electrode disposed adjacent said first side of said electron-permeable membrane so that fluent material passed by said membrane by said discharge means will contact said electrode and means for maintaining said electrode at a relatively negative electrical potential for attracting positively charged particles from the fluent material.

23. Apparatus as claimed in claim 22, wherein said fluent material discharge means includes a body defining a passageway having a section forming a venturi, and wherein said electron-permeable membrane and said electrode is disposed adjacent said section.

24. Apparatus as claimed in claim 22, wherein said fluent material discharge means includes a body defining a passageway having a discharge orifice, and wherein said electron-permeable membrane and said electrode is disposed adjacent said discharge orifice.

25. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and so that the discharged fluent material is dispersed at least partially under the influence of said net charge, the apparatus further comprising means for varying with time the quantity of said electrons provided at said second side of said electron-permeable membrane.

26. Apparatus as claimed in claim 25, wherein said electron supply means comprise an electron gun and wherein said means for varying the quantity of said electrons comprises means for varying the quantity of electrons emitted by said gun.

27. Apparatus as claimed in claim 26, wherein said electron gun comprises a cathode, a grid and one or more anodes, and wherein said means for varying the quantity of said electrons comprises means for varying the voltage between the grid and cathode.

28. Apparatus as claimed in claim 25, further comprising a device for receiving said discharged fluent material, said device being constructed and arranged to operate cyclically, and wherein said means for varying with time the quantity of said electrons comprises means for varying said quantity in synchronization with said cyclic operation of said device.

29. Apparatus as claimed in claim 28, wherein said device is an internal combustion engine.

30. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, said discharging step including the step of passing said fluent material through a passageway having a narrow section forming a venturi so that pressure of the fluent material is reduced below the pressure of the fluent material in other regions of the passageway as the fluent material passes through said section, said electron-permeable membrane being disposed adjacent said section, and wherein said step of supplying electrons includes the step of directing an electron beam at said electron-permeable membrane so that said beam impinges upon said fluent material in said section while the fluent material is at reduced pressure.

31. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and so that the discharged fluent material is dispersed at least partially under the influence of said net charge, said electron-permeable membrane comprising a film consisting essentially of boron nitride, the thickness of said film being less than about 3 microns.

32. Apparatus as claimed in claim 31, wherein said electron supply means comprises an electron gun and means for actuating said gun to apply an electron acceleration potential of less than 30 kV.

33. Apparatus for dispersing a fluent material comprising:

(a) an electron-permeable membrane having a first side and a second side;

(b) fluent material discharge means for passing fluent material to be dispersed past said first side of said electron-permeable membrane and discharging the fluent material; and (c) electron supply means for providing free electrons at said second side of said membrane so that the electrons pass through said membrane and enter the fluent material to provide a net negative charge on the fluent material discharged by said fluent material discharge means and so that the discharged fluent material is dispersed at least partially under the influence of said net charge, wherein said fluent material is a liquid and said fluent material discharge means comprises means for imparting a gaseous phase to said liquid before said liquid passes said electron-permeable membrane.

34. Apparatus as claimed in claim 33, wherein said means for imparting comprises means for initially atomizing said liquid before said liquid passes said electron-permeable so that membrane electrons supplied by said electron supply means enter said initially atomized liquid and said initially atomized liquid is further atomized under the influence of said net charge.

35. Apparatus for dispersing a fluent material, comprising:

(a) means for supplying said material;

(b) means for injecting electrons into said material so that the electrons enter the fluent material to provide a net negative charge on the fluent material and so that the fluent material is dispersed at least partially under the influence of mutual repellence of said net charge;

(c) a device for receiving said dispersed material, said device being constructed and arranged to operate cyclically; and (d) means for varying the quantity of said electrons injected into said material in synchronization with said cyclic operation to thereby vary the extent of said dispersion in synchronization with said cyclic operation of said receiving device.

36. Apparatus as claimed in claim 35, wherein said means for injecting comprise an electron gun, and wherein said means for varying comprise means for varying the quantity of electrons emitted by said gun.

37. Apparatus as claimed in claim 35, wherein said means for injecting includes a pair of opposed electrodes and means for applying different electrical potentials to said opposed electrodes, said means for supplying said fluent material including means for passing said fluent material between said electrodes so that electrons will be injected into the fluent material under the influence of said potentials, said means for varying including means for varying the potential on at least one of said electrodes.

38. Apparatus as claimed in claim 35, wherein said device for receiving comprises an internal combustion engine.

39. A method of dispersing a fluent material comprising the steps of:

(a) passing a fluent material to be dispersed past a first side of an electron-permeable membrane and discharging the fluent material;

(b) supplying electrons on a second, opposite side of said membrane so that the electrons pass through the membrane and enter the fluent material so as to provide a net charge on the discharged fluent material, whereby the discharged fluent material is dispersed at least partially under the influence of said net charge, said step of discharging said fluent material being conducted so that the static pressure of said fluent material is subatmospheric as said fluent material passes said electron-permeable membrane.

40. A method as claimed in claim 39, wherein said fluent material includes a gaseous phase.

41. A method as claimed in claim 40, wherein said fluent material includes a solid particulate in admixture with said gaseous phase.

* * * * *